US005803060A

United States Patent [19]

Skivran

[11] Patent Number: 5,803,060

[45] Date of Patent: Sep. 8, 1998

[54] MISSILE LAUNCHING

[75] Inventor: Joseph F. Skivran, Cincinnati, Ohio

[73] Assignee: Hasbro, Inc., Pawtucket, R.I.

[21] Appl. No.: 628,901

[22] Filed: Apr. 9, 1996

[51] Int. Cl.[6] ..... F41B 7/00; F41B 7/08

[52] U.S. Cl. ..... 124/16; 124/26

[58] Field of Search ..... 124/16, 20.3, 22, 124/26, 27, 31

[56] References Cited

U.S. PATENT DOCUMENTS

| | | | |
|---|---|---|---|
| 2,594,527 | 4/1952 | Wechsler | 124/26 X |
| 2,817,329 | 12/1957 | Wehrfritz | 124/27 |
| 2,830,570 | 4/1958 | Horowitz et al. | 124/52 |
| 2,878,615 | 3/1959 | Burgin | 124/26 X |
| 2,888,004 | 5/1959 | Steiner | 124/27 |
| 3,132,442 | 5/1964 | Barr | 124/16 X |
| 3,154,062 | 10/1964 | Ryan | 124/16 |
| 3,270,735 | 9/1966 | Petrusek | 124/31 X |
| 3,369,534 | 2/1968 | Crosman | 124/26 |
| 3,572,310 | 3/1971 | Chiba | 124/76 |
| 3,968,784 | 7/1976 | Miller | 127/27 |
| 4,199,893 | 4/1980 | Rittinger | 446/429 |
| 4,345,402 | 8/1982 | Hanson et al. | 446/430 |
| 5,156,137 | 10/1992 | Clayton | 124/27 |

FOREIGN PATENT DOCUMENTS 75 31394 5/1977 France .

*Primary Examiner*—John A. Ricci
*Attorney, Agent, or Firm*—Fish & Richardson, P.C.

[57] ABSTRACT

Missile launching apparatus includes a housing section and a trigger mechanism. The trigger mechanism is integrally formed from a common piece of material with the housing section to define a single component.

31 Claims, 3 Drawing Sheets

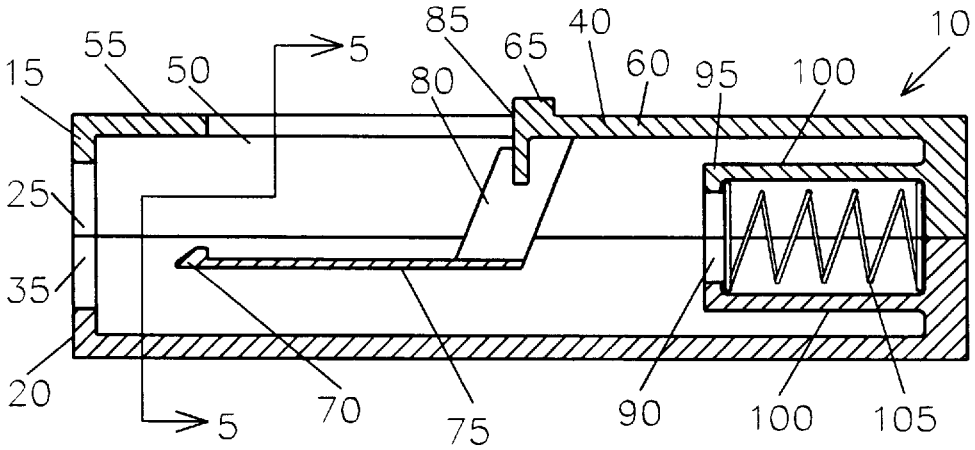
FIG. 4
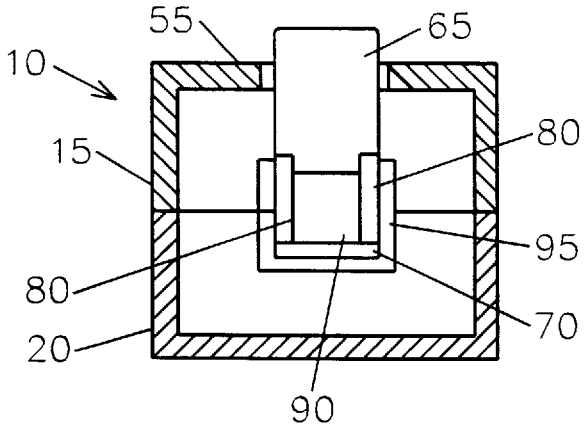
FIG. 5
FIG. 8
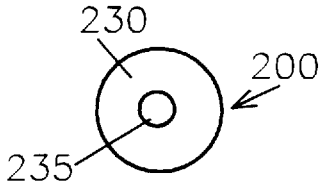
FIG. 6
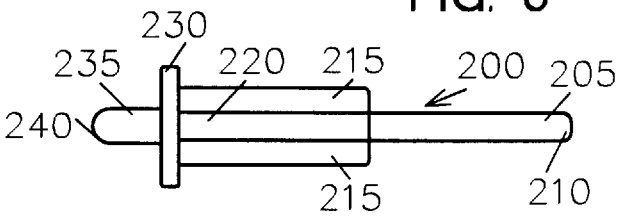
FIG. 9
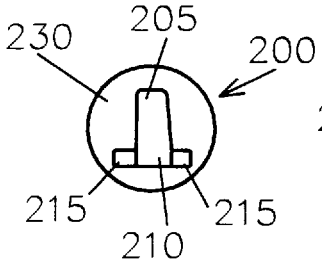
FIG. 7
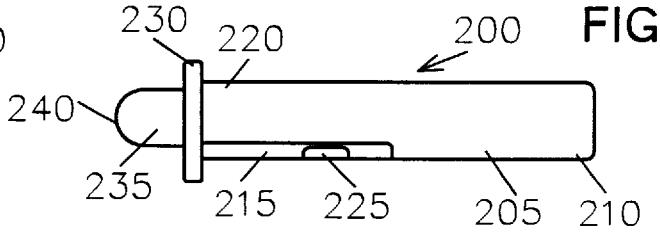

MISSILE LAUNCHING

The invention relates generally to toy missile launching.

The invention provides a missile launching apparatus for a toy that includes a resilient trigger formed as part of a housing of the missile launching apparatus.

In general, a missile launching apparatus according to the invention includes a housing section and a trigger mechanism. The housing section and the trigger mechanism are integrally formed from a common piece of material to define a single component. The apparatus may also include a second housing section that connects to the first housing section to form a housing.

Embodiments of the invention may include one or more of the following features. The trigger mechanism may define a channel through which a missile inserted into the apparatus passes. The trigger mechanism also may include a latch, and may be configured so that a missile inserted into the missile launching apparatus passes between the latch and a point at which the trigger mechanism extends from the first housing section. In particular, the trigger mechanism may define a channel between the latch and the point at which the trigger mechanism extends from the first housing section so that a missile inserted into the missile launching apparatus passes along the channel. The channel may be enclosed on four sides.

The trigger mechanism may include a resilient arm. The arm may extend from one side of an opening in a wall of the first housing section. In particular, the trigger mechanism may include a first portion that extends from the side of the opening and is aligned with the wall of the first housing section. The trigger mechanism may also include a second portion that is offset from the wall of the first housing section and on which the latch is mounted. The first and second portions may be connected together by connecting portions so that the first portion, the second portion, and the connecting portions together define the channel.

The missile launching apparatus may also include a spring positioned within the housing. Typically, the spring is compressed when a missile is inserted into the housing and decompresses to launch the missile.

In some embodiments, the sole components of the missile launching apparatus may be a first piece of material defining the first housing section and the trigger mechanism, a second piece of material defining the second housing section, and the spring. This arrangement is advantageous because it can be made from only two molded plastic parts.

The missile launching apparatus is suitable for a variety of uses. For example, the missile launching apparatus may be included in a toy by incorporating the missile launching apparatus into a wing or other component of the toy.

Other features, objects, and advantages of the invention will become apparent from the following detailed description when read in connection with the accompanying drawings, in which:

FIG. 4 is a sectional view of the missile launching apparatus of FIG. 1 taken along section 4—4 of FIG. 2;

FIG. 5 is a sectional view of the missile launching apparatus of FIG. 1 taken along section 5—5 of FIG. 4;

FIG. 6 is a top view of a missile for use with the missile launching apparatus of FIG. 1;

FIG. 7 is a side view of the missile of FIG. 6;

FIG. 8 is a front view of the missile of FIG. 7;

FIG. 9 is a rear view of the missile of FIG. 8;

Figure 1:
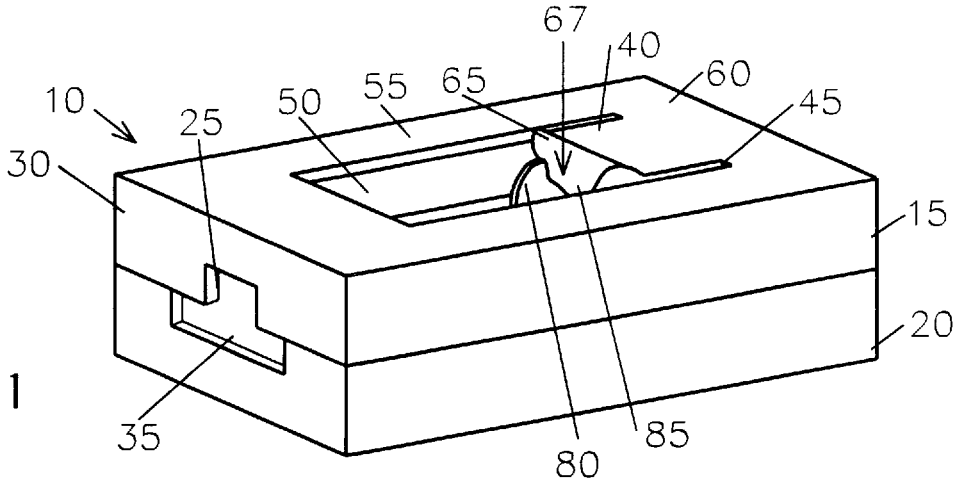
FIG. 1 is a perspective view of a missile launching apparatus according to the invention.
Figure 2:
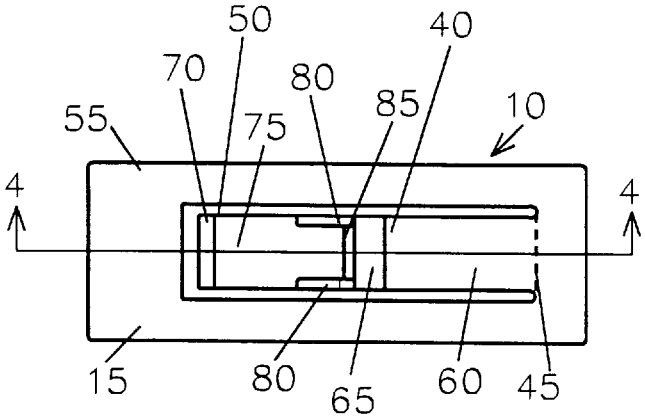
FIG. 2 is a top view of the missile launching apparatus of FIG. 1.
Figure 3:
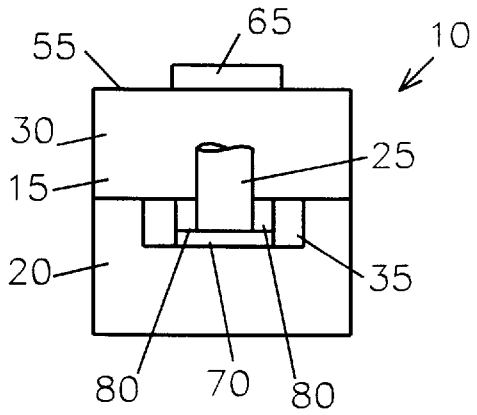
FIG. 3 is an end view of the missile launching apparatus of FIG. 1.

With reference now to the drawings and more particularly to FIGS. 1–3, a missile launching apparatus 10 includes a housing formed from a top housing section 15 and a bottom housing section 20. A narrow opening 25 in end 30 of top housing section 15 and a wide opening 35 in end 30 of bottom housing section 20 are aligned with each other to form an opening for insertion of a missile into missile launching apparatus 10.

A trigger mechanism 40 extends from an edge 45 of an opening 50 in an upper wall 55 of upper housing section 15. Trigger mechanism 40 includes a resilient cantilevered arm 60 that extends from edge 45. Arm 60 is flush with wall 55.

A ridge 65 at the opposite end of arm 60 from edge 45 extends above surface of wall 55. Pressure applied to ridge 65 in a direction perpendicular to and toward wall 55 (see arrow 67) causes arm 60 to bend. As discussed below, bending of arm 60 releases a missile positioned in missile launching apparatus 10.

Referring also to FIGS. 4 and 5, trigger mechanism 40 includes a latch 70 that is mounted on a horizontal section 75. Horizontal section 75 is positioned within the housing and is generally parallel to arm 60.

Horizontal section 75 is connected to arm 60 by a pair of sidewalls 80. The sidewalls 80 are directly connected to horizontal section 75 and are connected to the bottom of arm 60 and to sides of an extension 85 that extends from the bottom of ridge 65. Sidewalls 80 extend diagonally from arm 60 so that horizontal section 75 is offset from arm 60 in the horizontal direction.

Sidewalls 80, horizontal section 75, and extension 85 together form a channel through which an end of a missile passes when the missile is inserted into the missile launching apparatus. The channel guides the end of the missile toward an opening 90 in an end 95 of a spring housing 100 that contains a spring 105. When the end of the missile enters the spring housing, the end of the missile compresses spring 105.

FIGS. 6–9 illustrate a missile 200 for use with missile launching apparatus 10. Missile launching apparatus 10 and missile 200 are both typically made from plastic.

Missile 200 includes extended body 205 having a first end 210 for insertion into missile launching apparatus 10. Body 205 has a generally rectangular cross section that is relatively narrow horizontally and relatively thick vertically.

A latching structure 215 extends toward the first end from a second end 220 of body 205. Latching structure 215 extends from opposite sides of body 205 and has a bottom surface that is aligned with a bottom surface of body 205. A notch 225 in latching structure 215 cooperates with latch 70 of missile launching apparatus 10 to maintain missile 200 in the missile launching apparatus when spring 105 is compressed. In combination, body 205 and latching structure 215 have a cross section that conforms to the opening defined in end 30 of missile launching apparatus 10 by openings 25 and 35.

An annular flange 230 at a second end 220 of missile body 205 prevents over-insertion of missile 200. A cylindrical tip 235 extends from annular flange 230 and has a rounded end 240.

Figure 10:
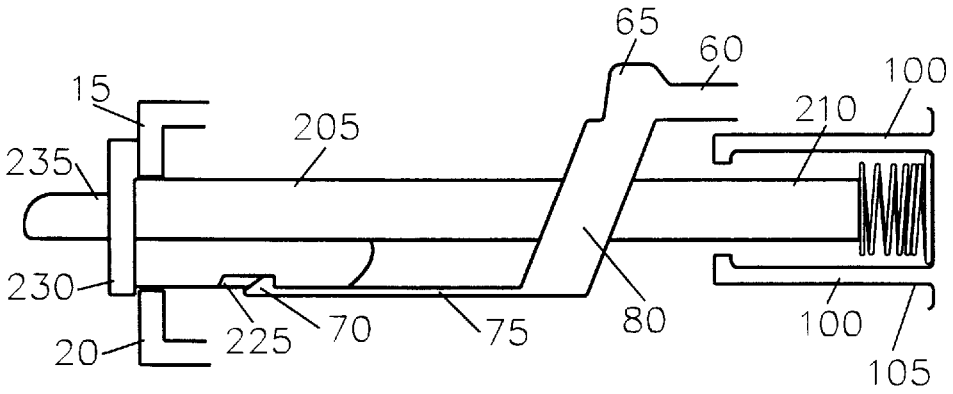
FIG. 10 is a side view illustrating placement of the missile of FIG. 6 in the missile launching apparatus of FIG. 1.

FIG. 10 illustrates the orientation of missile 200 relative to trigger mechanism 40 when missile 200 is positioned in missile launching apparatus 10. End 210 of body 205 of missile 200 extends into spring housing 100 and compresses spring 105. Missile 200 is held in place by the interaction of latch 70 with notch 225 in latching structure 215. Missile body 205 extends through the channel defined by horizontal portion 75 and sidewalls 80.

To position missile 200 in the orientation of FIG. 10, end 210 of missile 200 is inserted into the missile launching apparatus 10. Insertion force is applied until a leading edge of notch 225 moves past latch 70 and engages latch 70. Thereafter, missile 200 is retained in missile launching apparatus 10 even after insertion pressure is removed.

A downward pressure is applied to ridge 65 to launch missile 200. The downward pressure causes arm 60 to flex. Flexing of arm 60 has the effect of moving sidewalls 80 and horizontal section 75 as if they were rotating about an axis defined by arm 60, which causes the end of horizontal section 75 that includes latch 70 to move downward. Downward movement of latch 70 disengages latch 70 from notch 225. This disengagement leaves missile 200 free to move in the horizontal direction. As a result, spring 105 decompresses and launches missile 200 from missile launching apparatus 10.

Figure 11:
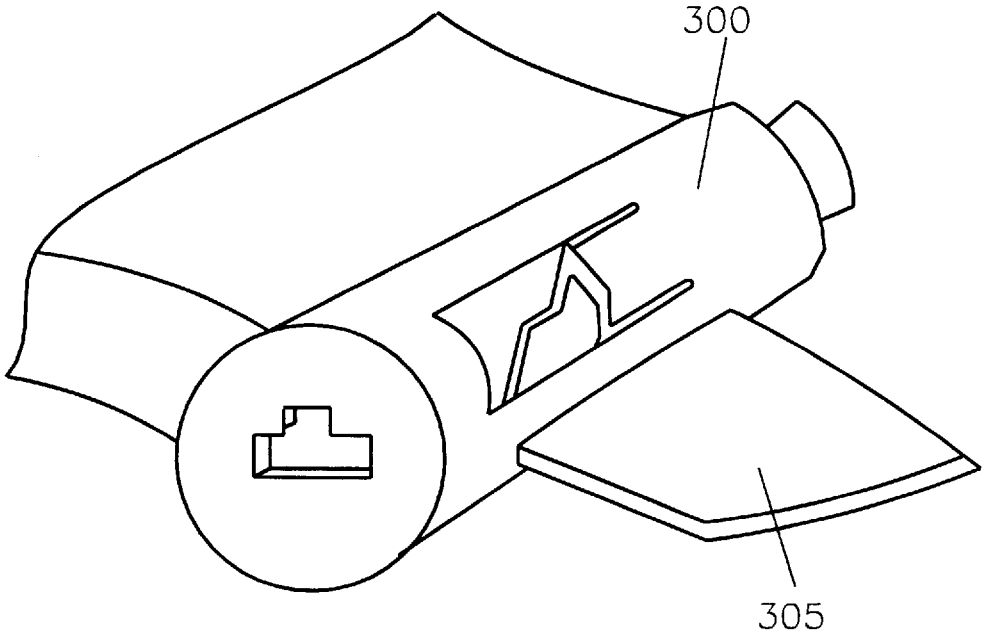
FIG. 11 is a perspective view illustrating a missile launching apparatus incorporated into a wing of a toy.

Other embodiments are within the following claims. In particular, missile launching apparatus 10 can be implemented in a variety of shapes and sizes. For example, as shown in FIG. 11, a generally cylindrical missile launching apparatus 300 can be incorporated into a wing 305 of a toy. In addition, the missile may have other forms. For example, the missile could be shaped to resemble an animal or a fanciful creature.

What is claimed is:

1. A toy missile receiving apparatus comprising:

a first housing section with an opening configured to receive a missile; and a trigger mechanism integrally formed from a common piece of material with the first housing section to define a single component, the trigger mechanism comprising a latch which is engageable with a received missile, the trigger mechanism further comprising a resilient portion which tends to bias the latch into engagement with the missile to thereby prevent the missile from being released from the housing, the trigger mechanism further including a portion which may be manipulated by a user to move the latch out of engagement with the missile to release the missile from the first housing section.

2. The missile receiving apparatus of claim 1, wherein the trigger mechanism defines a channel through which a missile inserted into the missile receiving apparatus passes.

3. The missile receiving apparatus of claim 1, wherein the trigger mechanism is configured so that a missile inserted into the missile receiving apparatus passes between the latch and a point at which the trigger mechanism extends from the first housing section.

4. The missile receiving apparatus of claim 3, wherein the trigger mechanism defines a channel between the latch and the point at which the trigger mechanism extends from the first housing section, and wherein a missile inserted into the missile receiving apparatus passes through the channel.

5. The missile receiving apparatus of claim 4, wherein the channel is enclosed on four sides.

6. The missile receiving apparatus of claim 1, wherein the resilient portion comprises a resilient arm.

7. The missile receiving apparatus of claim 6, wherein a wall of the first housing section includes an opening and wherein the trigger mechanism extends from one side of the opening.

8. The missile receiving apparatus of claim 7, wherein the trigger mechanism includes a first portion that extends from the one side of the opening in the wall of the first housing section and is aligned with the wall of the first housing section.

9. The missile receiving apparatus of claims 8, wherein the trigger mechanism comprises a second portion that is offset from the wall of the first housing section and on which the latch is mounted.

10. The missile receiving apparatus of claim 9, wherein the second portion is connected to the first portion by a pair of connecting portions.

11. The missile receiving apparatus of claim 10, wherein the first portion, the second portion, and the connecting portions together define a channel through which a missile inserted into the missile receiving apparatus passes.

12. The missile receiving apparatus of claim 1, further comprising a spring positioned within a region defined by the housing section, the spring being positioned and configured to provide a force for launching a missile received by the first housing section.

13. The missile receiving apparatus of claim 12, wherein the apparatus consists of:

a first piece of material defining the first housing section and the trigger mechanism, a second piece of material defining a second housing section, and the spring.

14. The missile receiving apparatus of claim 1, wherein a wall of the first housing section includes an opening and wherein the trigger mechanism extends from one side of the opening.

15. The missile receiving apparatus of claim 14, wherein the trigger mechanism comprises a resilient arm.

16. The missile receiving apparatus of claim 14, wherein the trigger mechanism includes a first portion that extends from the one side of the opening in the wall of the first housing section and is aligned with the wall of the first housing section.

17. The missile receiving apparatus of claim 14, wherein the trigger mechanism comprises a second portion that is offset from the wall of the first housing section and on which the latch is mounted.

18. The missile receiving apparatus of claim 17, wherein the second portion is connected to the first portion by a pair of connecting portions.

19. The missile receiving apparatus of claim 18, wherein the first portion, the second portion, and the connecting portions together define a channel through which a missile passes upon insertion into the missile receiving apparatus.

20. The missile receiving apparatus of claim 14, further comprising a spring positioned within a region defined by the first housing section.

21. The missile receiving apparatus of claim 20, wherein the apparatus consists of:

a first piece of material defining the first housing section and the trigger mechanism, a second piece of material defining a second housing section, and the spring.

22. A toy having a wing and including the missile receiving apparatus of claim 1, wherein the missile receiving apparatus is incorporated into the wing.

23. The missile receiving apparatus of claim 1, further comprising a spring positioned within a region defined by the first housing section.

24. The missile receiving apparatus of claim 23, wherein the apparatus consists of:

a first piece of material defining the first housing section and the trigger mechanism, a second piece of material defining second housing section, and the spring.

25. A toy having a wing and including the missile receiving apparatus of claim 24, wherein the missile receiving apparatus is incorporated into the wing.

26. A toy missile receiving apparatus comprising:

a housing section having a first opening and a wall with a second opening, the first opening being configured to receive a missile; and a trigger mechanism extending from and connected to one side of the second opening in the wall of the housing section, the trigger mechanism including a latch and being configured so that a missile inserted into the missile launching apparatus passes between the latch and a point at which the trigger mechanism extends from the side of the opening in the wall of the housing section, wherein the latch is configured to engage an inserted missile and to release the inserted missile in response to manipulation of the trigger mechanism.

27. The missile receiving apparatus of claim 26, wherein the trigger mechanism defines a channel between the latch and the point at which the trigger mechanism extends from the housing section, and wherein a missile inserted into the missile launching apparatus passes through the channel.

28. The missile receiving apparatus of claim 27, wherein the trigger mechanism comprises a resilient arm.

29. The missile receiving apparatus of claim 28, further comprising a spring positioned within a region defined by the housing section.

30. A toy having a wing and including the missile receiving apparatus of claim 29, wherein the missile receiving apparatus is incorporated into the wing.

31. A toy including the missile receiving apparatus of claim 26 and further comprising a missile positioned between the latch and the point at which the trigger mechanism extends from the side of the opening in the wall of the housing section.

* * * * *